US005654120A

United States Patent [19]

Hakata et al.

[11] Patent Number: 5,654,120

[45] Date of Patent: Aug. 5, 1997

[54] MAGNETIC CARRIER FOR ELECTROPHOTOGRAPHY

[75] Inventors: Toshiyuki Hakata, Hiroshima; Hiroomi Kakihara, Ohtake; Masaaki Fukugauchi, Hiroshima, all of Japan

[73] Assignee: Toda Kogyo Corporation, Japan

[21] Appl. No.: 538,951

[22] Filed: Oct. 4, 1995

[30] Foreign Application Priority Data

Oct. 5, 1994 [JP] Japan ..... 6-266248
Oct. 5, 1994 [JP] Japan ..... 6-266249

[51] Int. Cl.[6] ..... G03G 9/083; G03G 9/107

[52] U.S. Cl. ..... 430/106.6; 430/108

[58] Field of Search ..... 430/108, 106.6

[56] References Cited

U.S. PATENT DOCUMENTS 5,422,216 6/1995 Smith et al. ..... 430/108
5,466,552 11/1995 Sato et al. ..... 430/108
5,500,320 3/1996 Saha ..... 430/108

FOREIGN PATENT DOCUMENTS 0 317 667 6/1989 European Pat. Off. .
0 384 697 8/1990 European Pat. Off. .

OTHER PUBLICATIONS

Patent Abstracts of Japan, vol. 13 No. 368 (P–919), 16 Aug. 1989 & JP–A–01 124868 (Minolta) 17 May 1989, abstract.

Database WPI–Section Ch, Week 9224, Derwent Publications Ltd., London, GB, Class G08, AN–92–196283 & JP–A–04 124 677 (Fuji Xerox), 24 Apr. 1992, Abstract.

*Primary Examiner*—John Goodrow
*Attorney, Agent, or Firm*—Nixon & Vanderhye

[57] ABSTRACT

The disclosure describes a magnetic carrier for electrophotography having a number-average particle diameter of 1 to 1000 μm, and comprising ferromagnetic iron compound particles, non-magnetic metal oxide particles and a phenol-based resin as a binder resin, the total amount of said ferromagnetic iron compound particles and said non-magnetic metal oxide particles being 80 to 99 wt %, and the ratio of the number-average particle diameter of said non-magnetic metal oxide particles and the number-average particle diameter of said ferromagnetic iron compound particles being more than 1.0.

16 Claims, 3 Drawing Sheets

(X 2,000)

(X 2,000)

(X 1,500)

(X 1,500)

(X 5,000)

MAGNETIC CARRIER FOR ELECTROPHOTOGRAPHY

BACKGROUND OF THE INVENTION

The present invention relates to a magnetic carrier for electrophotography, and more particularly, to a magnetic carrier for electrophotography composed of spherical composite particles which have a small bulk density, an excellent fluidity, an appropriate saturation magnetization, especially a saturation magnetization of about 20 to 90 emu/g, an appropriate specific gravity (i.e., true specific gravity), especially a specific gravity of about 2.5 to 5.2, and a comparatively high electric resistance, especially an electric resistance of about $10^{10}$ to $10^{14}$ Ωcm.

As is known, in the method adopted by electrophotography, a photoconductive material such as selenium, OPC (organic semiconductor) and a-Si is used for a photoreceptor, an electrostatic latent image is formed by various means, and toner electrified to the opposite polarity to the polarity of the latent image is adhered to the latent image by an electrostatic force by magnetic brush development or the like so as to develop the image.

In the developing process, particles so called a carrier is used. The carrier provides a toner with an appropriate amount of positive or negative electric charge by frictional electrification and carries the toner, by utilizing a magnetic force, to a developing area in the vicinity of the surface of a photoreceptor with the latent image formed thereon, through a developing sleeve which accommodates a magnet.

With the increasingly wide use of electrophotography in copying machines, printers, etc., electrophotography has recently been required to deal with various objects such as fine lines, small letters, photograph and colored manuscripts. Electrophotography is also required to improve the picture quality, to enhance the dignity, to increase the speed of the copying and to enable continuous processing of the copying. There requests are expected to be increasing more and more.

As a carrier, iron powder carrier, ferrite carrier, binder-type carrier (composite particles of fine magnetic particles dispersed in a resin), etc. have conventionally been developed and put to practical use.

An iron powder carrier which has a shape of flakes, sponges or spheres have a specific gravity of about 7 to 8 and a bulk density as large as 3 to 4 g/cm$^3$, so that it requires a large driving force when stirred in a developing machine, which is apt to lead to much mechanical wear, exhaustion of the toner, deterioration in the electrification property of the carrier itself, and a damage in the photoreceptor.

A ferrite carrier is composed of spherical particles, and has a specific gravity of about 4.5 to 5.5 and a bulk density of about 2 to 3 g/cm$^3$, so that it can solve the problem of a heavy weight which is suffered from by an iron powder carrier, to a certain degree but it is still insufficient.

A binder-type carrier has a bulk density as small as not more than 2.5 g/cm$^2$, and since it is comparatively easy to form spherical particles therefrom which has little distortion in shape and a high particle strength, it has an excellent fluidability. In addition, it is possible to control the particle size of the binder-type carrier in a wide range. The binder-type carrier is thus expected most as a carrier for a developing sleeve, a high-speed copying machine in which the number of revolutions of the magnet in a developing sleeve is large, a high-speed laser beam printer of a general-purpose computer, etc.

The known resins used for a binder-type carrier are roughly divided into thermoplastic resins such as vinyl-based resins, styrene-based resins and acrylic-based resins, and thermosetting resins such as phenol-based resins, melamine-based resins and epoxy-based resins. Thermoplastic resins which are easy to granulate are generally used and thermosetting resins are considered to have a problem in practical use because it is difficult to form spherical particles therefrom.

On the other hand, since thermosetting resins are superior in the durability, the shock resistance and the heat resistance to thermoplastic resins, a binder-type carrier (composite particles) composed of inorganic particles and a thermosetting resin having these merits is strongly demanded, and composite particles using a phenol resin as a thermosetting resin and ferromagnetic particles as inorganic particles is known (Japanese Patent Application Laid-Open (KOKAI) Nos. 2-220068/1990 and 4-100850/1992). However, there is no end to the demand for higher capacity of a binder-type carrier and it is required to have appropriately controlled magnetization value, specific gravity and electric resistance in addition to the above-described properties.

A carrier is firstly required to have an appropriate saturation magnetization, especially a saturation magnetization of about 20 to 90 emu/g. In other words, when the saturation magnetization is in the range of 20 to 90 emu/g, it is possible to obtain a good image. If the saturation magnetization is not less than 20 emu/g, there is little possibility of exhibiting a carrier adherence phenomenon which is a phenomenon of a carrier forming what is called an "ear" of a magnet brush on a sleeve leaving from the ear and flying and adhering to the photoreceptor due to a lower magnetic force. If the saturation magnetization is not more than 90 emu/g, it is possible to lower the mechanical strength applied to a magnetic toner, thereby preventing the magnetic toner from crushing. A carrier is therefore required to have a saturation magnetization in the range of 20 to 90 emu/g.

A carrier is secondly required to electrify a toner quickly. In other words, it is important that a carrier is mixed well with a toner. For this purpose, a carrier is required to have an appropriate specific gravity, especially, a specific gravity of about 2.5 to 5.2. If a carrier has a large specific gravity, it is mixed well with a toner. But in order to prevent a carrier from doing damage to the toner, for example, to prevent exhaustion of the toner, and to reduce the size and the weight of a developing machine, a carrier having a small specific gravity is desirable. Therefore, a carrier is required to have a specific gravity of about 2.5 to 5.2.

A carrier is thirdly required to have a comparatively high electric resistance, especially an electric resistance of about $10^{10}$ to $10^{14}$ Ωcm. If a carrier has a volume intrinsic resistance as low as not more than $10^6$ Ωcm, the carrier adheres to the image portion of the photoreceptor by injection of charge from the sleeve, or the charge releases from the latent image, which leads to a disturbance in the latent image or a defect of the image.

In order to solve this problem, a method of covering the surfaces of carrier particles with a resin so as to increase the electric resistance of the carrier is proposed (Japanese Patent Application Laid-Open (KOKAI) Nos. 47-13954/1972 and 57-660/1982).

However, since such a resin is an insulator, the electric resistance of the carrier itself becomes much higher than $10^{14}$ Ωcm, and the carrier charge is unlikely to leak. In addition, the charge of the toner is increased and as a result, the image produced has an edge effect but the density in the center portion becomes very low in an image having a large area. Consequently, a carrier is required to have a comparatively high electric resistance, particularly a volume intrinsic resistance of about $10^{10}$ to $10^{14}$ Ωcm.

Some attempts have conventionally been made to produce a binder-type carrier having an appropriate electric resistance. For example, a magnetic powder dispersion-type carrier with a fine inorganic oxide powder adhered to the surfaces of at least a part thereof by adding the fine inorganic oxide powder to the carrier in advance (Japanese Patent Application Laid-Open (KOKAI) No. 4-124677/1992), and magnetic particles dispersion-type carrier with fine conductive particles having a volume resistance of not more than $10^{12}$ Ωcm added to the surfaces thereof (Japanese Patent Application Laid-Open (KOKAI) No. 5-273789/1993) are proposed.

A magnetic carrier composed of spherical composite particles which have a small bulk density and an excellent fluidity, and which have all of the following properties with a good balance: an appropriate saturation magnetization, especially a saturation magnetization of about 20 to 90 emu/g, an appropriate specific gravity, especially a specific gravity of about 2.5 to 5.2, and a comparatively high electric resistance, especially an electric resistance of about $10^{10}$ to $10^{14}$ Ωcm, is now in the strongest demand, but such a magnetic carrier has never been provided.

The binder-type carriers composed of spherical phenol resin composite particles containing ferromagnetic particles described in Japanese Patent Application Laid-Open (KOKAI) Nos. 2-220068/1990 and 4-100850/1992 are not aimed at the control of the electric resistance due to the ratio of the particle diameters of the ferromagnetic particles and the non-magnetic particles. The electric resistances of these carriers are less than $10^{10}$ Ωcm, which is beyond the range described above.

Neither the carrier described in Japanese Patent Application Laid-Open (KOKAI) No. 4-124677/1992 nor the carrier described in Japanese Patent Application Laid-Open KOKAI) 5-273789/1993 can be said to sufficiently meet the above-described demands.

Each of these carriers described in Japanese Patent Application Laid-Open (KOKAI) Nos. 4-124677/1992 and 5-273789/1993 is produced by adhering a fine inorganic oxide powder to the surfaces of the composite particles containing ferromagnetic particles, and since the carrier does not have a coating layer of the fine inorganic oxide powder uniformly dispersed in a resin matrix, the fine inorganic oxide powder is easily peeled off by a mechanical shock.

Accordingly, a magnetic carrier composed of spherical composite particles which has a small bulk density, an excellent fluidity, and which satisfies all of the conditions of an appropriate saturation magnetization, especially a saturation magnetization of about 20 to 90 emu/g, an appropriate specific gravity, especially a specific gravity of about 2.5 to 5.2, and a comparatively high electric resistance, especially an electric resistance of about $10^{10}$ to $10^{14}$ Ωcm is now demanded.

As a result of the studies undertaken by the present inventors so as to meet the above-mentioned demand, it has been found that by dispersing ferromagnetic iron compound particles and non-magnetic metal oxide particles which have a number-average particle diameter larger than that of the ferromagnetic iron compound particles to a phenol-based resin as a binder resin so that the total amount of the ferromagnetic iron compound particles and the non-magnetic metal oxide particles is 80 to 99 wt % in a magnetic carrier for electrophotography, the obtained spherical composite particles are useful as a magnetic carrier for electrophotography which is capable of realizing high picture quality, high dignity, high speed of the copying and continuous processing of the copying. The present invention has been achieved on the basis of this finding.

SUMMARY OF THE INVENTION

It is an object of the present invention to provide a magnetic carrier for electrophotography composed of spherical composite particles which has a small bulk density, an excellent fluidity, and which satisfies all of the conditions of an appropriate saturation magnetization, especially a saturation magnetization of about 20 to 90 emu/g, an appropriate specific gravity, especially a specific gravity of about 2.5 to 5.2, and a comparatively high electric resistance, especially an electric resistance of about $10^{10}$ to $10^{14}$ Ωcm.

To achieve this aim, in a first aspect of the present invention, there is provided a magnetic carrier for electrophotography comprising spherical composite particles having a number-average particle diameter of 1 to 1000 μm, and comprising ferromagnetic iron compound particles, non-magnetic metal oxide particles and a phenol-based resin as a binder resin, wherein the total amount of the ferromagnetic iron compound particles and the non-magnetic metal oxide particles is 80 to 99 wt %, and the ratio ($r_b/r_a$) of the number-average particle diameter ($r_b$) of the non-magnetic metal oxide particles and the number-average particle diameter ($r_a$) of the ferromagnetic iron compound particles is more than 1.0.

In a second aspect of the present invention, there is provided a magnetic carrier for electrophotography comprising spherical composite particles having a number-average particle diameter of 1 to 1000 μm and a coating layer composed of at least one selected from the group consisting of a thermosetting resin and a thermoplastic resin formed on the surfaces thereof, wherein the spherical composite particles are composed of ferromagnetic iron compound particles, non-magnetic metal oxide particles and a phenol-based resin as a binder for binding the ferromagnetic iron compound particles and the non-magnetic metal oxide particles, the total amount of the ferromagnetic iron compound particles and the non-magnetic metal oxide particles is 80 to 99 wt %, and the ratio ($r_b/r_a$) of the number-average particle diameter ($r_b$) of the non-magnetic metal oxide particles and the number-average particle diameter ($r_a$) of the ferromagnetic iron compound particles is more than 1.0.

In a third aspect of the present invention, there is provided a magnetic carrier for electrophotography comprising spherical composite particles having a number-average particle diameter of 1 to 1000 μm and a coating layer composed of at least one selected from the group consisting of a thermosetting resin and a thermoplastic resin, and non-magnetic metal oxide particles, formed on the surfaces of the spherical composite particles, wherein the spherical composite particles are composed of ferromagnetic iron compound particles, non-magnetic metal oxide particles and a phenol-based resin as a binder for binding the ferromagnetic iron compound particles and the non-magnetic metal oxide particles, the total amount of the ferromagnetic iron compound particles and the non-magnetic metal oxide particles in the spherical composite particles is 80 to 99 wt %, and the ratio ($r_b/r_a$) of the number-average particle diameter ($r_b$) of the non-magnetic metal oxide particles and the number-average particle diameter ($r_a$) of the ferromagnetic iron compound particles is more than 1.0.

In the fourth aspect of the present invention, there is provided a developer for electrophotography comprising a carrier define in the first aspect and a toner.

In the fifth aspect of the present invention, there is provided a developer for electrophotography comprising a carrier define in the second aspect and a toner.

In the sixth aspect of the present invention, there is provided a developer for electrophotography comprising a carrier define in the third aspect and a toner.

DETAILED DESCRIPTION OF THE INVENTION

Figure 1:
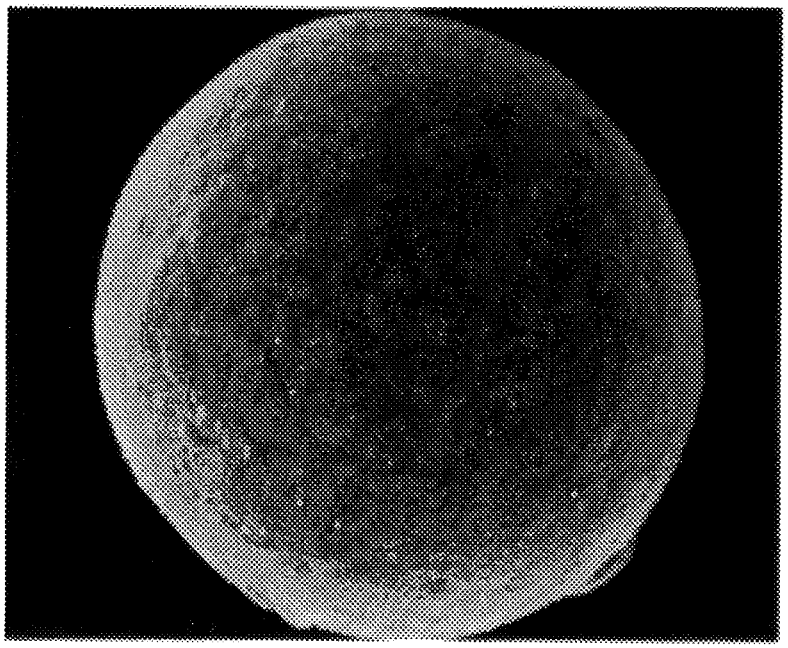
FIG. 1 is a scanning electron micrograph (×1500) showing the particle structure of the spherical composite particles A obtained in Example 1.

The spherical composite particles used in the present invention will first be described.

The spherical composite particles used in the present invention have a number-average particle diameter of 1 to 1000 μm. The particles having a number-average particle diameter of less than 1 μm have a tendency of secondary agglomeration. On the other hand, the particles having a number-average particle diameter of more than 1000 μm have a low mechanical strength and make it impossible to produce a clear image. In order to obtain a specially high picture quality, the preferable number-average particle diameter of the spherical composite particles is 20 to 200 μm, more preferably 30 to 100 μm.

The spherical composite particles in the present invention include ferromagnetic iron compound particles and non-magnetic metal oxide particles, and the total sum of the ferromagnetic iron compound particles and the non-magnetic metal oxide particles is 80 to 99 wt %, preferably 80 to 97 wt %. If the total sum is less than 80 wt %, since the amount of the resin increases, it is impossible to obtain an appropriate specific gravity. If the total sum exceeds 99 wt %, it is impossible to obtain composite particles having an adequate strength due to a shortage of the binder.

The content of the non-magnetic metal oxide particles is in the range of 5 to 70 wt % based on the total amount of the ferromagnetic iron compound particles and the non-magnetic metal oxide particles (total amount of inorganic particles). The content of the non-magnetic metal oxide particles is preferably 10 to 70 wt %, more preferably 20 to 60 wt % based on the total amount of inorganic particles. If the content of the non-magnetic metal oxide particles is less than 5 wt % based on the total amount of inorganic particles, it is impossible to obtain an appropriately high electric resistance. On the other hand, if the content exceeds 70 wt % based on the total amount of inorganic particles, it is impossible to obtain an adequate magnetization.

The spherical composite particles used in the present invention have preferably a sphericity of 1.0 to 1.4, more preferably 1.0 to 1.2. The sphericity is represented by the following formula:

$$\text{Sphericity}=l/w$$

wherein l represents an average major axial diameter of spherical composite particles, and w represents an average minor axial diameter of spherical composite particles.

The spherical composite particles used in the present invention have preferably a bulk density of less than about 2.5 g/cm$^3$.

The ratio ($r_b/r_a$) of the number-average particle diameter ($r_b$) of the non-magnetic metal oxide particles and the number-average particle diameter ($r_a$) of the ferromagnetic iron compound particles which constitute the spherical composite particles of the present invention is more than 1.0, preferably 1.2 to 5.0, more preferably 0.2 to 4.0. If the ratio is not more than 1.0, since the size of the ferromagnetic iron compound particles is the same as that of the non-magnetic metal oxide particles, or the ferromagnetic iron compound particles rather become relatively large, the ratio of the ferromagnetic iron compound particles occupying the surfaces of the composite particles increases. In other words, a larger amount of ferromagnetic iron compound particles are exposed to the surfaces of the composite particles than the non-magnetic metal oxide particles, and the exposure ratio of the ferromagnetic iron compound particles is increased. As a result, the ferromagnetic iron compound particles easily come into contact with each other, so that the electric resistance on the surfaces of the composite particles may be lowered to less than $10^{10}$ Ωcm. In contrast, in the composite particles of the present invention, the ratio ($r_b/r_a$) is more than 1, i.e., the exposure ratio of the non-magnetic metal oxide particles on the surfaces of the composite particles is high, so that the non-magnetic metal oxide particles easily come into contact with each other and it is possible to obtain an electric resistance of not less than $10^{10}$ Ωcm. For the purpose of uniform mixture, the ratio ($r_b/r_a$) is preferably not more than 5.0.

The spherical composite particles used in the present invention have a saturation magnetization of 20 to 90 emu/g, preferably 30 to 75 emu/g. If the saturation magnetization exceeds 90 emu/g, the carrying properties of the carrier due to the magnetism increases so much that there is a fear of a magnetic toner being crushed. On the other hand, if the saturation magnetization is less than 20 emu/g, the carrier separates from the surface of the developing sleeve and adheres to the surface of a photoreceptor, and produces a defect in the image.

The specific gravity of the spherical composite particles in the present invention is 2.5.to 5.2, preferably 2.5 to 4.5.

The spherical composite particles in the present invention has an electric resistance of $10^{10}$ to $10^{14}$ Ωcm. If the electric resistance is less than $10^{10}$ Ωcm, the charge on the electrostatic latent image is apt to be flown through the carrier, which may lead to a disturbance or defect of the image. If it exceeds $10^{14}$ Ωcm, the carrier charge is unlikely to leak and the charge of the toner is increased, which leads to a problem such as a very thin density in the center portion of a uniformly black part having a large area.

A process of producing the spherical composite particles used in the present invention will now be explained.

The ferromagnetic iron compound particles usable in the present invention are ferromagnetic iron oxide particles such as magnetite particles and maghetite particles; spinel ferrite particles containing at least one metal (e.g., Mn, Ni, Zn, Mg and Cu) other than iron; magnetoplumbite ferrite particles such as barium ferrite particles; and fine iron or iron alloy particles having an oxide film on the surfaces thereof. Among these, ferromagnetic iron oxide particles such as magnetite particles are preferable. The number-average particle diameter of the ferromagnetic iron compound particles is preferably 0.02 to 5 μm, more preferably 0.05 to 3 μm with the dispersion of the ferromagnetic iron compound particles in an aqueous medium and the strength of the spherical composite particles produced taken into consideration. The shape of the ferromagnetic iron compound particles may be any of a granular shape, a spherical shape, a spindle shape and an acicular shape.

The electric resistance of the non-magnetic metal oxide particles used in the present invention is not less than $10^{10}$ Ωcm, preferably not less than $10^{12}$ Ωcm. Examples of the non-magnetic metal oxide particles are fine particles of titanium oxide, silica, alumina, zinc oxide, magnesium oxide, hematite, goethite and ilmenite. If the difference in the specific gravity between the ferromagnetic iron compound particles and the non-magnetic metal oxide particles is considered, hematite, zinc oxide, titanium oxide, etc. are preferable. The number-average particle diameter of the non-magnetic metal oxide particles is preferably 0.05 to 10 μm, more preferably 0.1 to 5 μm with the dispersion of the non-magnetic metal oxide particles in an aqueous medium and the strength of the spherical composite particles produced taken into consideration. The shape of the ferromagnetic iron compound particles may be any of a granular shape, a spherical shape, a spindle shape and an acicular shape.

The spherical composite particles having a coating layer on the surface thereof are preferred.

In the case where the coating layer is composed of a resin, the coating layer on the surfaces of the spherical composite particles of the present invention is preferably 0.1 to 50 parts by weight, more preferably 0.5 to 20 parts by weight based on 100 parts by weight of the spherical composite particles.

In the case where the coating layer is composed of a resin containing fine non-magnetic metal oxide particles, it is preferable that the amount of the resin in the coating layer is 0.1 to 50 parts by weight based on 100 parts by weight of the spherical composite core particles, the amount of the fine non-magnetic metal oxide particles contained in the coating layer are 0.1 to 10 parts by weight based on 100 parts by weight of the spherical composite core particles, and the amount of the coating layer is 0.2 to 50 parts by weight based on 100 parts by weight of the spherical composite core particles. More preferably, the amount of the resin in the coating layer is 0.5 to 20 parts by weight based on 100 parts by weight of the spherical composite core particles, the amount of the fine non-magnetic metal oxide particles contained in the coating layer are 0.2 to 5 parts by weight based on 100 parts by weight of the spherical composite core particles and the amount of the coating layer is 0.7 to 20 parts by weight based on 100 parts by weight of the spherical composite core particles. If the coating layer exceeds 50 parts by weight, the electric resistance unfavorably becomes too high.

If the ratio ($r_b/r_a$) of the number-average particle diameter ($r_b$) of the non-magnetic metal oxide particles and the number-average particle diameter ($r_a$) of the ferromagnetic iron compound particles in the spherical composite particles is not more than 1.0, as seen from the afore-mentioned disclosure, since the size of the ferromagnetic iron compound particles is the same as that of the non-magnetic metal oxide particles, or the ferromagnetic iron compound particles rather become relatively large, the ratio of the ferromagnetic iron compound particles occupying the surfaces of the composite particles increases. Since the electric resistance of the spherical composite particles before forming the coating layer of a resin is lowered to less than $10^{10}$ Ωcm, it is necessary to increase the thickness of the coating layer of a resin in order to obtain a comparatively high electric resistance.

The particle diameter of the fine non-magnetic metal oxide particles contained in the coating layer is preferably not more than 1 μm, more preferably 0.02 to 0.5 μm with the thickness of the coating layer taken into consideration. The shape of the non-magnetic metal oxide particles may be any of a granular shape, a spherical shape, a spindle shape and an acicular shape.

The fine non-magnetic metal oxide particles usable in the coating layer preferably have an electric resistance of not less than $10^{10}$ Ωcm, more preferably not less than $10^{12}$ Ωcm. Examples of the fine non-magnetic metal oxide particles are fine particles of titanium oxide, silica, alumina, zinc oxide, magnesium oxide, hematite, goethite and ilmenite. Among these, hematite, zinc oxide, titanium oxide, etc. are preferable because the specific gravity thereof is little different from that of the ferromagnetic iron compound particles.

As examples of phenols constituting a phenol-based resin as a binder resin in the present invention, compounds having a phenolic hydroxyl group such as phenol, an alkylphenol including m-cresol, p-tert-butylphenol, o-propylphenol, resorcinol and bisphenol A, and halogenited phenols obtained by substituting all or a part of hydrogen in the benzene nucleus or the alkyl group by a chlorine atom or a bromine atom may be cited, but a phenol is the most preferable. When a resin other than the phenol-based resin is used, it is difficult to produce particles or even if particles are produced, they are sometimes irregular.

An aldehyde used in the present invention is exemplified by formaldehyde and furfural in the form of formalin or paraldehyde. Among these, formaldehyde is especially preferable.

The molar ratio of the aldehydes to the phenols is preferably 1 to 4, more preferably 1.2 to 3. If the molar ratio of the aldehydes to the phenols is less than 1, it is difficult to produce particles or even if particles are produced, since the curing of the resin is slow in progress, it is often the case that the particles produced have a low strength. On the other hand, if the molar ratio of the aldehyde to the phenol is more than 4, there is a tendency of the unreacted aldehyde remaining in an aqueous medium after the reaction increasing.

As a basic catalyst used in the present invention, catalysts which are used for the production of an ordinary resol resin are usable. They are, for example, ammonia water, hexamethylene tetramine, and alkylamines such as dimethylamine, diethyltriamine and polyethyleneimine. The molar ratio of the basis catalyst to the phenols is preferably 0.02 to 0.3.

The amount of the ferromagnetic iron compound particles and the non-magnetic metal oxide particles coexisting during the reaction of the phenols and the aldehyde in the presence of the basic catalyst is preferably 0.5 to 200 times by weight that of the phenol. When the strength of the spherical composite particles produced are taken into consideration, the amount of the ferromagnetic iron compound particles and the non-magnetic metal oxide particles is more preferably 4 to 100 times by weight that of the phenols.

Although the ferromagnetic iron compound particles and the non-magnetic metal oxide particles in the present invention are usable as they are without any surface treatment, they may be lipophilic-treated in advance. When the ferromagnetic iron compound particles and the non-magnetic metal oxide particles which are not subjected to a lipophilic-treatment are used, it is easy to produce spherical composite particles by adding a hydrophilic organic compound such as carboxymethylcellulose and polyvinyl alcohol or a fluorine compound such as calcium fluoride thereto as a suspension stabilizer.

As a lipophilic-treatment, there are a method of mixing a coupling agent such as a silane-based coupling agent and a titanate-based coupling agent with the ferromagnetic iron compound particles and the non-magnetic metal oxide particles so as to coat the particles, and a method of dispersing the ferromagnetic iron compound particles and the non-magnetic metal oxide particles in an aqueous medium containing a surfactant so that the surfactant is absorbed to the surfaces of the particles.

Such a lipophilic-treatment may be applied either simultaneously or separately to the ferromagnetic iron compound particles and the non-magnetic metal oxide particles. Alternatively, the treatment may be applied only to either of the ferromagnetic iron compound particles and the non-magnetic metal oxide particles.

As the silane-based coupling agent, one having a hydrophobic group, an amino group or an epoxy group may be cited. Examples of the silane-based coupling agent having a hydrophobic group are vinyltrichlorosilane, vinyltriethoxysilane and vinyl-tris(β-methoxy) silane.

Examples of the silane-based coupling agent having an amino group are γ-aminopropyltriethoxysilane, N-β-(aminoethyl)-γ-aminopropyltrimethoxysilane, N-β-(aminoethyl)-γ-aminopropylmethyldimethoxysilane and N-phenyl-γ-aminopropyltrimethoxysilane.

Examples of the silane-based coupling agent having an epoxy group are γ-glycidoxypropylmethyldiethoxysilane, γ-glycidoxypropyltrimethoxysilane and β-(3,4-epoxycyclohexyl)trimethoxysilane, As the titanate-based coupling agent are usable isopropyltriisostearoyl titanate, isopropyltridodecylbenzenesulfonyl titanate, isopropyltris(dioctylpyrophosphate) titanate, etc.

As the surfactant, commercially available surfactants are usable. A surfactant having a functional group which can bond with the ferromagnetic iron compound particles, the non-magnetic metal oxide particles or the hydroxyl group on the surfaces of these particles is preferable, and a cationic or anionic surfactant is preferable.

Although the purpose thereof is achieved by using any of the above-described treating methods, a treatment using a silane coupling agent having an amino group or an epoxy group is preferable from the point of view of the adhesion of the particles to the phenol-based resin.

The reaction in the present invention is carried out in an aqueous medium. The total amount of the ferromagnetic iron compound particles and the non-magnetic metal oxide particles charged into the aqueous medium is preferably 30 to 95 wt %, more preferably 60 to 90 wt % in total solids in the total raw material.

The reaction is carried out in the following manner. Phenol, formalin, water, ferromagnetic iron compound particles and non-magnetic metal oxide particles are charged into a reaction vessel, and after the mixture is adequately agitated, a basic catalyst is added and the temperature is raised to 70° to 90° C. while stirring the resultant mixture, thereby curing the phenol-based resin. At this time, it is preferable to raise the temperature gradually in order to obtain spherical composite particles having a high sphericity. The temperature rising rate is preferably 0.5° to 1.5° C./min, more preferably 0.8° to 1.2° C./min.

The cured reaction product is cooled to not higher than 40° C. to obtain a water dispersion, and after the solid-liquid separation of the water dispersion by an ordinary method such as filtering and centrifugal separation, the solid content is washed and dried, thereby obtaining the spherical composite particles composed of the ferromagnetic iron compound particles and the non-magnetic metal oxide particles bound by a phenol-based resin as a binder.

The resin used for the formation of the coating layer in the present invention is at least one selected from the group consisting of a thermosetting resin and a thermoplastic resin. More specifically, it is at least one selected from the group consisting of phenol-based resin, epoxy-based resin, melamine-based resin, polyamide-based resin, polyester-based resin, styrene-based resin, silicon-based resin and fluorine-based resin. Among these, a phenol-based resin is preferable from the point of view of adhesion because the spherical composite particles use a phenol-based resin as a binder.

The coating layer is formed from a resin by any method such as a method of blowing the resin to the spherical composite particles by using a spray drier, a method of mixing the spherical composite particles and the resin in a dry process using a Henschel mixer, a high-speed mixer or the like, and a method of soaking the spherical composite particles in a solution containing the resin.

The formation of the coating layer composed of a phenol-based resin on the surfaces of the spherical composite core particles by the method of soaking the spherical composite core particles in a solution containing the phenol-based resin will be explained in more detail. Phenol, formalin, water and spherical composite particles are charged into a reaction vessel, and after the mixture is adequately agitated, a basic catalyst is added and the temperature is adjusted to 70° to 90° C. while stirring the mixture, thereby curing the phenol-based resin. The cured reaction product is cooled to not higher than 40° C. to obtain a water dispersion, and after the solid-liquid separation of the water dispersion by an ordinary method such as filtering and centrifugal separation, the obtained solid content is washed and dried, thereby obtaining the spherical composite particles with coating layers of the phenol-based resin formed on the surfaces thereof.

The coating layer composed of a phenol-based resin and non-magnetic metal oxide particles is formed in the same way as in the formation of a coating layer from a phenol-based resin except for adding the non-magnetic metal oxide particles together with the phenol-based resin. In this manner, the spherical composite particles with coating layers of the phenol-based resin and the non-magnetic metal oxide particles formed on the surfaces thereof are obtained.

The non-magnetic metal oxide particles may be subjected to a lipophilic-treatment in advance.

When the spherical composite particles are coated with a thermosetting resin, a heat-treatment, for example, adequate curing of the resin at a temperature of 100° to 350° C. is necessary. In addition, in order to prevent oxidization of the ferromagnetic iron compound particles contained in the spherical composite particles, it is preferable to treat the resin in an inactive atmosphere, for example, while flowing an inert gas such as helium, argon and nitrogen. As a heat-treating furnace, any one such as a fixed furnace and a rotary furnace may be used, but a rotary furnace is preferable in order to prevent agglomeration of particles.

As the toner in the present invention, all electrifying toners which are produced by dispersing a coloring agent in a binder resin and which are used in ordinary electrophotography are usable without special limitation.

Examples of a binder resin used for the production of a toner are homopolymers or copolymers, e.g., styrenes such as styrene and chlorostyrene; monoolefins such as ethylene, propylene, butylene and isobutylene; vinyl esters such as vinyl acetate, vinyl propionate, vinyl benzoate and vinyl acetate; G-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate and dodecyl acrylate; vinyl ethers such as vinylmethyl ether, vinylethyl ether and vinylbutyl ether; and vinylketones such as vinylmethylketone, vinylhexylketone and vinylisopropylketone. Especially typical binder resins are polystyrene, styrene-alkyl acrylate copolymer, styrene-alkyl methacrylate copolymer, styrene-acrylonitrile copolymer, styrene-butadiene copolymer, styrene-anhydrous maleic acid copolymer, polyethylene and polypropylene. In addition, polyester, polyurethane, epoxy resin, silicon resin, polyamide, denatured rosin, and paraffin wax are also usable.

As the examples of a coloring agent for a toner may be cited carbon black, nigrosine dye, aniline blue, chalcoile blue, chrome yellow, ultramarine blue, Du Pont Oil Red, quinoline yellow, methylene blue chloride, phthalocyanine blue, malachite green oxalate, lamp black, Rose sengale, C.I.Pigment-Red 48:1, C.I.Pig-Red 122, C.I.Pigment-Red 57:1, C.I.Pig. Yellow 97, C.I.Pig-Yellow 12, C.I.Pigment-.Blue 15:1 and C.I.Pigment-Blue 15:3.

It is possible to add, as occasion demands, an electrification controller, cleaning adjuvant, flowability accelerator to the toner in the present invention.

The toner used in the present invention may be a magnetic toner containing a magnetic material, or a capsule toner, or a polymer toner produced by a suspension polymerizing method or a dispersion polymerizing method, etc.

The toner particles in the present invention have a number-average particle diameter of not more than about 30 μm, preferably 3 to 20 μm.

As described above, as a carrier for electrophotography, it is required that all of the saturation magnetization, the specific gravity and the electric resistance are appropriately controlled.

The surfaces of carrier particles are conventionally covered with a resin so as to stabilize the frictional electrification property. However, since a binder-type carrier generally has a high electric resistance, if the surfaces are further covered with an insulating resin, the electric resistance of the carrier exceeds $10^{14}$ Ωcm, and the carrier charge is unlikely to leak. In addition, the charge of the toner is increased and as a result, the density of the image obtained becomes very low.

As a countermeasure, a method of controlling the electric resistance by adhering fine inorganic particles to the surfaces of composite core particles containing ferromagnetic particles is proposed, but since these fine inorganic particles are only adhered, the structure is unstable and since the contact area between the composite particles is very small, this method cannot be said to be favorable for the control of the electric resistance.

The present inventors selected ferromagnetic iron compound particles and non-magnetic metal oxide particles so that the ratio ($r_b/r_a$) of the number-average particle diameter ($r_b$) of the non-magnetic metal oxide particles and the number-average particle diameter ($r_a$) of the ferromagnetic iron compound particles is more than 1.0 in order to increase the ratio in which the non-magnetic metal oxide particles having a relatively large particle diameter are exposed to the outermost surface of the spherical composite particles produced by blending the ferromagnetic iron compound particles and the non-magnetic metal oxide particles with a phenol-based resin as a binder, and to control the electric resistance of the spherical composite particles in the range of $10^{10}$ to $10^{13}$ Ωcm.

In addition, coating layers were formed on the surfaces of the composite core particles so as to control the electric resistance of the spherical composite particles in the range of $10^{10}$ to $10^{14}$ Ωcm.

As described above, it is important to select the ferromagnetic iron compound particles and the non-magnetic metal oxide particles so that the ratio ($r_b/r_a$) of the number-average particle diameter ($r_b$) of the non-magnetic metal oxide particles and the number-average particle diameter ($r_a$) of the ferromagnetic iron compound particles is more than 1.0 in order to control the electric resistance of the spherical composite particles in the range of $10^{10}$ to $10^{13}$ Ωcm.

If the ratio ($r_b/r_a$) is not more than 1.0, since the size of the ferromagnetic iron compound particles is the same as that of the non-magnetic metal oxide particles, or the ferromagnetic iron compound particles rather become relatively large, the ratio of the ferromagnetic iron compound particles occupying the surfaces of the composite particles increases, so that the electric resistance on the surfaces of the particles is lowered to less than $10^{10}$ Ωcm.

By selecting the ferromagnetic iron compound particles and the non-magnetic metal oxide particles so that the ratio ($r_b/r_a$) of the number-average particle diameter ($r_b$) of the non-magnetic metal oxide particles and the number-average particle diameter ($r_a$) of the ferromagnetic iron compound particles exceeds 1.0, it is easily possible to control the electric resistance of the spherical composite particles in the range of $10^{10}$ to $10^{13}$ Ωcm.

By enhancing the electric resistance of the spherical composite core particles to about $10^{10}$ to $10^{13}$ Ωcm, in case of forming a coating layer composed of (i) a resin, or (ii) a resin and fine non-magnetic metal oxide particles on the surfaces of the spherical composite core particles, it is possible to control the electric resistance of the spherical composite particles to a comparatively high value, i.e., in the range of $10^{12}$ to $10^{14}$ Ωcm.

In the case of forming a coating layer composed of a resin and fine non-magnetic metal oxide particles, it is possible to provide a carrier having not only a controlled electric remittance but also a small change in the moisture absorption and an excellent environment stability with respect to the electrification property due to the presence of the fine non-magnetic metal oxide particles contained in the coating layer. In addition, by using hematite, zinc oxide, titanium oxide, etc. as fine non-magnetic metal oxide particles, the specific gravity of which is little different from that of the ferromagnetic iron compound particles, it is possible to maintain a constant specific gravity even if the magnetization and the electric resistance are controlled.

It is, therefore, possible to control the electric resistance of the spherical composite particles of the present invention to a comparatively high value because the number-average particle diameter of the non-magnetic metal oxide particles is larger than the number-average particle diameter of the ferromagnetic iron compound particles, so that the ratio of the non-magnetic metal oxide particles which occupy the surfaces of the spherical composite particles is large. Thus, the spherical composite particles of the present invention are capable of satisfying all the conditions of an appropriate saturation magnetization, especially a saturation magnetization of about 20 to 90 emu/g, an appropriate specific gravity, especially a specific gravity of about 2.5 to 5.2, and a comparatively high electric resistance, especially an electric resistance of about $10^{10}$ to $10^{13}$ Ωcm, so that the spherical composite particles are optimum as the magnetic carrier for electrophotography which can improve the picture quality, enhance the dignity, increase the speed and enable continuous processing of the copying.

In addition, when the spherical composite particles are coated with a resin, since they have a higher electric resistance, especially an electric resistance of about $10^{12}$ to $10^{14}$ Ωcm in addition to the appropriate saturation magnetization and specific gravity, they are optimum as the magnetic carrier for electrophotography which can improve the picture quality, enhance the dignity, increase the speed and enable continuous processing.

When the spherical composite particles of the present invention having the above-described properties are used for a carrier, they are well mixed with a toner, thereby increasing the electrification speed of the toner. In addition, it is possible to suppress the exhaustion of the toner without doing any damage to the toner, and suppress excessive charge on the toner, so that it is possible to maintain a stable charge of the toner even if the carrier is used for a long time. Furthermore, control of magnetization in accordance with a developing machine is easy.

A developer according to the present invention is, therefore, capable of maintaining an excellent charge exchangeability and a high electrification speed, so that it is possible to form a copy image having a high picture quality at a high speed over a long term.

EXAMPLES

The present invention will now be described in more detail with reference to the following examples, but the present invention is not restricted to those examples and various modifications are possible within the scope of the invention.

The average particle size diameter of the spherical composite particles in the examples and comparative examples are expressed by the values measured by a laser diffraction-type particle size distribution meter (manufactured by Horiba Seisakusho Ltd.), and the configurations of the particles were observed by a scanning electron microscope (S-800, manufactured by Hitachi Ltd.)

The sphericity was calculated by the following formula after extracting not less than 250 spherical composite particles from the scanning electron microscope (S-800, manufactured by Hitachi Ltd.), and obtaining the average major axial diameter and the average minor axial diameter:

$$\text{Sphericity}=l/w$$

wherein l: average major axial diameter of spherical composite particles, and w: average minor axial diameter of spherical composite particles.

The bulk density was measured in accordance with a method of JIS K5101.

The ratio ($r_b/r_a$) of the average particle diameter ($r_b$) of the non-magnetic metal oxide particles and the average particle diameter ($r_a$) of the ferromagnetic iron compound particles in the spherical composite particles was calculated from the average particle diameter of the ferromagnetic iron compound particles and the average particle diameter ($R_b$) of the non-magnetic metal oxide particles used.

The saturation magnetization is expressed by the value measured under an external magnetic field of 10 KOe by an vibration sample magnetometer VSM-3S-15 (manufactured by Toei Kogyo, Co., Ltd.)

A true specific gravity is expressed by the value measured by a multivolume densimeter (manufactured by Michromeritics Corp.).

The electric resistance is expressed by the value measured by High resistance meter 4329A (manufactured by Yokokawa Hewlett Packard Corp.).

In order to obtain the charge of the toner, 95 parts by weight of the spherical composite particles were mixed with 5 parts by weight of either of a commercially available toner (A): CLC-200 Black (produced by Cannon Inc.) and a toner (B): 4800 (produced by Ricoh Company Ltd.). The charge of 200 mg of the mixture was measured by a blow-off charge measuring machine MODEL TB-200 (manufactured by Toshiba Chemical Co., Ltd.) as a value A (μC). The charge of the toner is expressed by the value per g calculated from the formula:

$$A\times 1/(0.2\times 0.05)\ (\mu C/g).$$

The content of the ferromagnetic iron compound particles, the content of the non-magnetic metal oxide particles and the content of the resin in each of the spherical composite core particles and the spherical composite particles were calculated from the measured specific weight and the saturation value of each of the spherical composite core particles and the spherical composite particles.

If it is assumed that the specific weight of the ferromagnetic iron compound particles is represented by p, the specific weight of the non-magnetic metal oxide particles is represented by q, the specific weight of the resin is represented by r, the contents thereof in the spherical composite core particles are represented by x, y and z (wt %), respectively, and the contents thereof in the spherical composite particles are represented by X, Y and Z (wt %), respectively, the specific gravity (d) of the spherical composite core particles and the specific gravity (D) of the spherical composite particles are represented by the following formulas (1) and (2), respectively:

$$d=(x+y+z)/[(x/p)+(y/q)+(z/r)] \quad (1)$$

$$D=(X+Y+Z)/[(X/p)+(Y/q)+(Z/r)] \quad (2)$$

Since x+y+z=X+Y+Z=100, $$z=100-x-y, \text{ and } Z=100-X-Y.$$

If it is assumed that the saturation magnetization of the ferromagnetic iron compound particles is represented by σ, the saturation magnetization of the spherical composite core particles is represented by $\sigma_p$, and the saturation magnetization of the spherical composite particles represents by $\Sigma_p$, the content (x) of the ferromagnetic iron compound particles in the spherical composite core particles is represented by $\sigma_p/\sigma\times 100$, the content (X) of the ferromagnetic iron compound particles in the spherical composite particles is represented by $\Sigma_p/\sigma\times 100$, so that the following formulas (3) and (4) hold:

$$d=100/[(x/p)+(y/q)+(100-x-y)/r] \quad (3)$$

$$D=100/[(X/p)+(Y/q)+(100-X-Y)/r] \quad (4)$$

By substituting the specific gravity (d) of the spherical composite core particles, the specific gravity (D) of the spherical composite particles, the specific gravity (p) of the non-magnetic metal oxide particles, the specific gravity (r) of the resin, the contents (x) and (X) of the non-magnetic metal oxide particles in the formulas (3) and (4), it is possible to obtain the contents (y) and (Y) of the non-magnetic metal oxide particles and the contents (z) and (Z) of the resin.

The contents of the ferromagnetic iron compound particles and the non-magnetic metal oxide particles were added as the contents of the inorganic particles.

<Production of spherical composite core particles>

Example 1

50 g of phenol, 75 g of 37% formalin, 320 g of spherical magnetite particles (average particle diameter: 0.24 μm), 80 g of granular hematite particles (average particle diameter: 0.40 μm), 1.0 g of calcium fluoride, 15 g of 28% ammonia water and 50 g of water were charged into a 1-liter four-neck flask, and the temperature was raised to 85° C. in 40 minutes while stirring and mixing the materials. With the temperature held at 85° C., the resultant mixture was brought into reaction for 180 minutes so as to be cured. Thereafter, the temperature of the contents of the flask was lowered to 30° C. and 0.5 liter of water was added to the reaction mixture. The supernatant was removed, and the precipitate was washed with water and air-dried. The precipitate was then dried at 150° to 160° C. under a reduced pressure (not more than 5 mmHg), thereby obtaining spherical composite particles A composed of the spherical magnetite particles and the granular hematite particles bound by a phenol resin as a binder.

The spherical composite particles A obtained had an average particle diameter of 40.1 μm and a spherical shape approximate to a complete sphere, as shown in the scanning electron micrograph (×1500) in FIG. 1. The properties of the spherical composite particles A are shown in Table 2.

Example 2

160 g of spherical magnetite particles (average particle diameter: 0.24 μm) were charged into a 500-ml flask, and after sufficient stirring, 1.2 g of a silane coupling agent (KBM-602, produced by Shin-etsu Chemical Industry Co., Ltd.) was added. The temperature was raised to about 100° C. and the materials were adequately stirred and mixed for 30 minutes, thereby obtaining the spherical magnetite particles coated with the coupling agent.

Separately from this, 240 g of granular hematite particles (average particle diameter: 0.40 μm) were charged into a 500-ml flask, and after sufficient stirring, 1.8 g of a silane coupling agent (KBM-403, produced by Shin-etsu Chemical Industry Co., Ltd.) was added. The temperature was raised to about 100° C. and the materials were adequately stirred and mixed for 30 minutes, thereby making the particles lipophilic and obtaining the granular hematite particles coated with the coupling agent.

45 g of phenol, 67 g of 37% formalin, 160 g of the lipophilic-treated spherical magnetite particles, 240 g of lipophitic-treated granular hematite particles, 14 g of 28% ammonia water and 50 g of water were charged into a 1-liter four-neck flask, and the temperature was raised to 85° C. in 40 minutes while stirring the resultant mixture. With the temperature held at 85° C., the mixture was brought into reaction for 180 minutes so as to be cured. Thereafter, the temperature of the contents of the flask was lowered to 30° C. and 0.5 liter of water was added to the reaction mixture. The supernatant was removed, and the precipitate in the lower layer was washed with water and air-dried. The precipitate was then dried at 150° to 160° C. under a reduced pressure (not more than 5 mmHg), thereby obtaining spherical composite particles B composed of the spherical magnetite particles and the granular hematite particles bound by a phenol resin as a binder. The spherical composite particles B obtained had an average particle diameter of 38.5 μm and a spherical shape approximate to a complete sphere. The properties of the spherical composite particles B are shown in Table 2.

Figure 5:
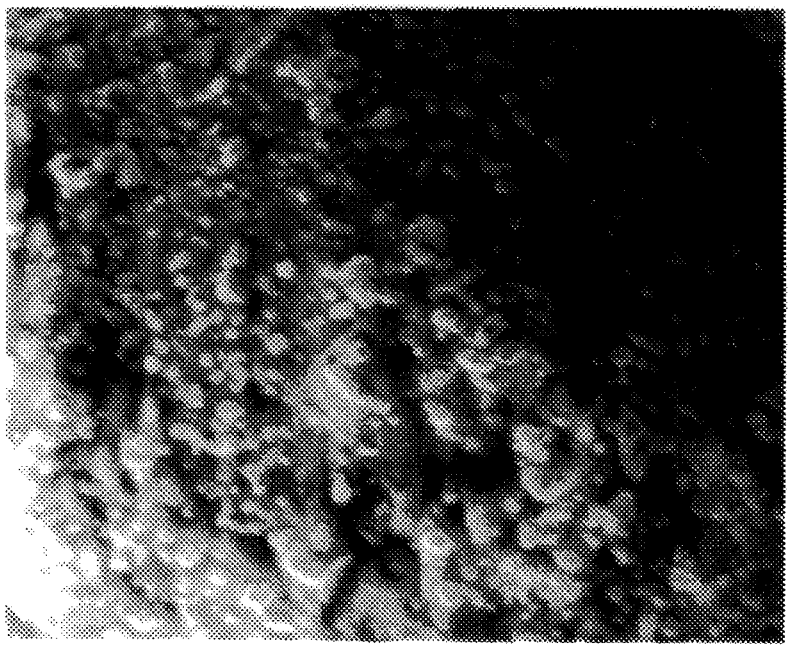
FIG. 5 is a scanning electron micrograph (×5000) showing the particle surface of the spherical composite particles B obtained in Example 2.

As shown in the scanning electron micrograph (×5000) in FIG. 5, a large number of hematite particles as non-magnetic metal oxide particles having a large number-average particle diameter were exposed on the surface of the spherical composite particles B obtained.

Examples 3 to 7, Comparative Example 1

Spherical composite particles C to H were obtained by the same reaction, curing and post-treatment as in Example 1 except that the kind, the amount and the lipophilic-treatment or non-lipophilic-treatment of the ferromagnetic iron compound particles and non-magnetic metal oxide particles, the amounts of phenol, formalin, ammonia water as a basic catalyst and water were varied as shown in Table 1, and that the spherical magnetite particles and the non-magnetic metal oxide particles were subjected to the lipophilic-treatment simultaneously or separately from each other.

<Production of resin coating layer>

Example 8

2 g of phenol, 2.7 g of 37% formalin, 100 g of the spherical composite particles A as the core particles, 40 g of water and 1 g of 28% ammonia water were charged into a 500-ml four-neck flask while stirring, and the temperature was raised to 85° C. in 30 minutes. With the temperature held at 85° C., the mixture was brought into reaction for 120 minutes so as to be cured.

Figure 2:
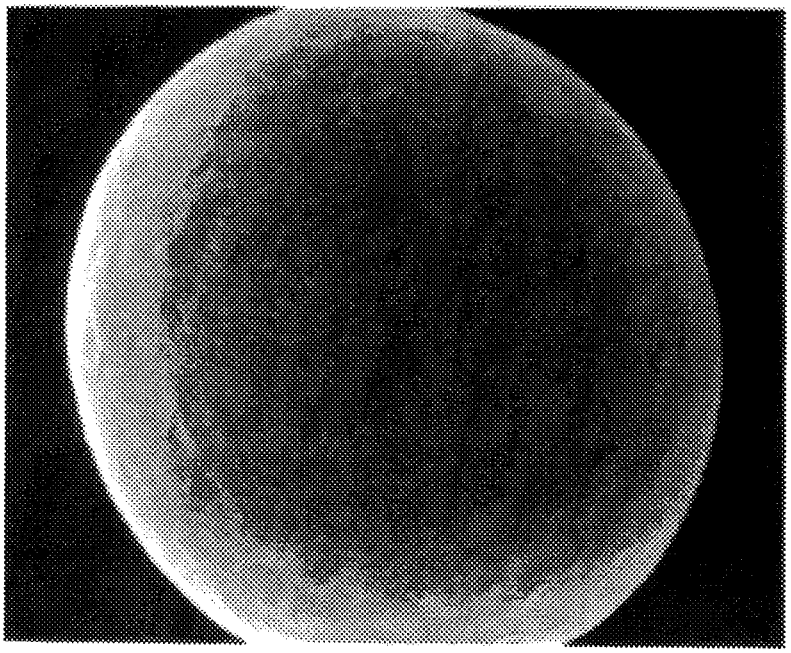
FIG. 2 is a scanning electron micrograph (×1500) showing the particle structure of the spherical composite particles I obtained in Example 8.

Thereafter, the temperature of the contents of the flask was lowered to 30° C. and 0.5 liter of water was added to the reaction mixture. The supernatant was removed, and the granular material was washed with water and air-dried. The granular material was then dried at 150° to 160° C. under a reduced pressure (not more than 5 mmHg), thereby obtaining spherical composite particles I coated with a phenol resin. The spherical composite particles I obtained had an average particle diameter of 41.9 μm and a spherical shape approximate to a complete sphere, as shown in the scanning electron micrograph (×1500) in FIG. 2.

The content of the non-magnetic metal oxide particles in the spherical composite particles I was 19.9 wt % in the total amount of the ferromagnetic iron compound particles and the non-magnetic metal oxide particles as a result of calculation from the measured magnetization and the measured specific gravity. The content of the phenol resin was 13.1 wt % in the total amount. The properties of the spherical composite particles I are shown in Table 4.

Example 9

3 g of phenol, 4.1 g of 37% formalin, 100 g of the fine spherical composite particles B as the-core particles, 1 g of granular hematite particle (average particle diameter: 0.16 μm), 50 g of water and 1.5 g of 28% ammonia water were charged into a 500-ml four-neck flask while stirring, and the temperature was raised to 85° C. in 30 minutes. With the temperature held at 85° C., the mixture was brought into reaction for 120 minutes so as to be cured.

Figure 3:
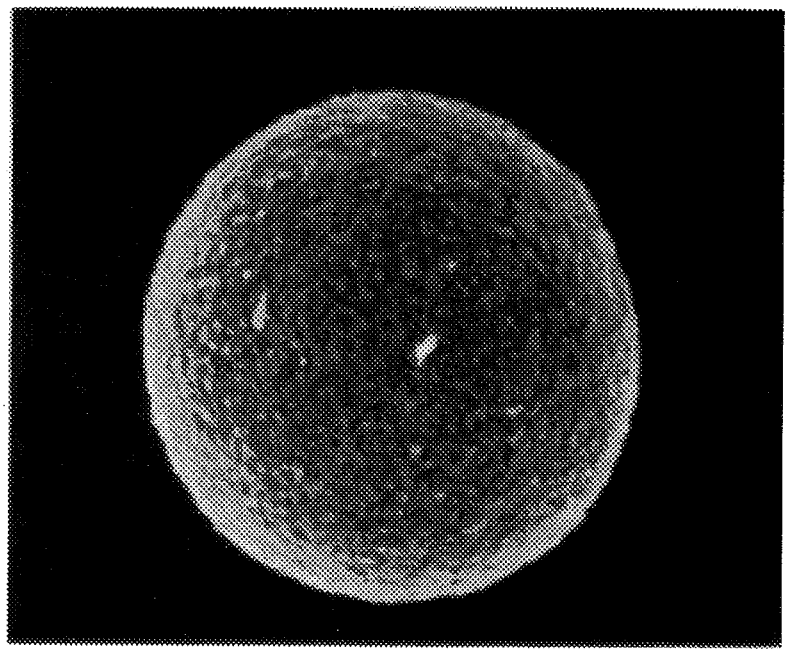
FIG. 3 is a scanning electron micrograph (×2000) showing the particle structure of the spherical composite particles J obtained in Example 9.

Thereafter, the temperature of the contents of the flask was lowered to 30° C. and 0.5 l of water was added to the reaction mixture. The supernatant was removed, and the granular material was washed with water and air-dried. The granular material was then dried at 150° to 160° C. under a reduced pressure (not more than 5 mmHg), thereby obtaining spherical composite particles J coated with a phenol resin. The spherical composite particles J obtained had an average particle diameter of 41.1 μm and a spherical shape approximate to a complete sphere, as shown in the scanning electron micrograph (×2000) in FIG. 3.

The content of the non-magnetic metal oxide in the spherical composite particles J was 60.4 wt % in the total amount of the ferromagnetic iron compound particles and the non-magnetic metal oxide particles as a result of calculation from the measured magnetization and the measured specific gravity. The content of the phenol resin was 15.6 wt % in the total amount. The properties of the spherical composite particles J are shown in Table 4.

Examples 10 to 12, Comparative Example 2

Spherical composite particles K to N were obtained by the same reaction and curing as in Example 8 or 9 except that the presence or absence, the kind and the amount of the non-magnetic metal oxide particles, the amounts of phenol, formalin, ammonia water as a basic catalyst and water were varied as shown in Table 3. The properties of the spherical composite particles K to N obtained are shown in Table 4.

Example 13

Figure 4:
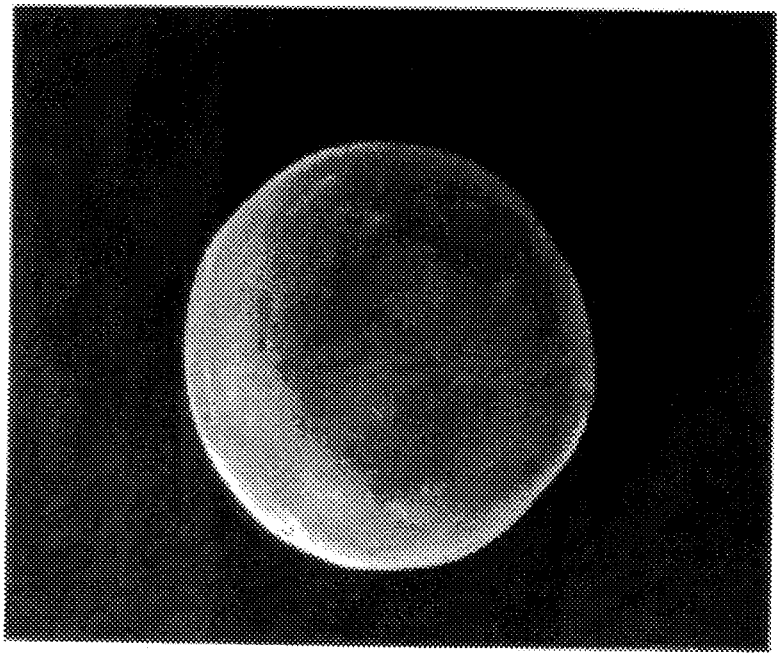
FIG. 4 is a scanning electron micrograph (×1000) showing the particle structure of the spherical composite particles O obtained in Example 13.

1 kg of the spherical composite particles A as the core particles, and 20 g of a styrene resin (Himer-SB-75, produced by Sanyo Chemical Industries Co., Ltd.) were charged into a Henschel mixer, and the temperature was raised to 120° C. while stirring the mixture in a nitrogen atmosphere and the temperature of 120° C. was kept for 1 hour while stirring the mixture in a nitrogen atmosphere, thereby obtaining spherical composite particles O coated with the styrene resin. The spherical composite particles O obtained had an average particle diameter of 40.8 μm and a spherical shape approximate to a complete sphere, as shown in the scanning electron micrograph (×1000) in FIG. 4. The properties of the spherical composite particles O are shown in Table 6.

Examples 14 to 18

Coating layers were produced and the spherical composite particles P to T were obtained in the same way as in Example 10 except that the kind of the spherical composite core particles, and the kind and the amount of the resin were varied. The producing conditions are shown in Table 5 and the properties of the spherical composite particles P to T obtained are shown in Table 6.

The obtained spherical composite particles P were mixed with a toner for using in a full-color laser copying machine CLC-200 (manufactured by Canon Inc.) to obtain a developer. The picture-forming test of the obtained developer was carried out by using the full-color laser copying machine CLC-200 (manufactured by Canon Inc.). As the result, a distinct picture in which an image portion had sufficiently high density and a non-image portion had no fog, was obtained.

TABLE 1

| | Ferromagnetic iron compound particles | | | |
|---|---|---|---|---|
| | Kind | | Lipophilic-treatment agent | |
| | (particle diameter:$r_a$) | Quantity (g) | Kind | Quantity (g) |
| Ex. 1 | Spherical magnetite (particle diameter 0.24 μm) | 320 | — | — |
| Ex. 2 | Spherical magnetite (particle diameter 0.24 μm) | 160 | Silane coupling agent (KBM-602: produced by Shin-etsu Chemical Industry Co., Ltd.) | 1.2 |
| Ex. 3 | Spherical magnetite (particle diameter 0.24 μm) | 370 | Silane coupling agent (KBM-403: produced by Shin-etsu Chemical Industry Co., Ltd.) | 2.78 |
| Ex. 4 | Spherical magnetite (particle diameter 0.24 μm) | 280 | Silane coupling agent (KBM-403: produced by Shin-etsu Chemical Industry Co., Ltd.) | 2.1 |
| Ex. 5 | Spherical magnetite (particle diameter 0.30 μm) | 380 | Silane coupling agent (KBM-403: produced by Shin-etsu Chemical Industry Co., Ltd.) | 1.9 |
| Ex. 6 | Spherical magnetite (particle diameter 0.24 μm) | 360 | Silane coupling agent (KBM-602: produced by Shin-etsu Chemical Industry Co., Ltd.) | 2.7 |
| Ex. 7 | Spherical magnetite (particle diameter 0.24 μm) | 300 | Silane coupling agent (KBM-403: produced by Shin-etsu Chemical Industry Co., Ltd.) | 2.25 |
| Comp. Ex. 1 | Spherical magnetite (particle diameter 0.24 μm) | 240 | Silane coupling agent (KBM-403: produced by Shin-etsu Chemical Industry Co., Ltd.) | 1.8 |

| | Non-magnetic metal oxide particles | | | |
|---|---|---|---|---|
| | Kind | | Lipophilic-treatment agent | |
| | (particle diameter:$r_b$) | Quantity (g) | Kind | Quantity (g) |
| Ex. 1 | Granular hematite (particle diameter 0.40 μm) | 80 | — | — |
| Ex. 2 | Granular hematite (particle diameter 0.40 μm) | 240 | Silane coupling agent (KBM-403: produced by Shin-etsu Chemical Industry Co., Ltd.) | 1.8 |
| Ex. 3 | Granular hematite (particle diameter 0.60 μm) | 30 | Silane coupling agent (KBM-403: produced by Shin-etsu Chemical Industry Co., Ltd.) | 0.15 |
| Ex. 4 | Granular hematite (particle diameter 0.27 μm) | 120 | Silane coupling agent (KBM-403: produced by Shin-etsu Chemical Industry Co., Ltd.) | 0.9 |
| Ex. 5 | Granular zinc oxide (particle diameter | 20 | Silane coupling agent (KBM-403: produced by Shin-etsu Chemical Industry | 0.1 |

TABLE 1-continued

| | | | | |
|---|---|---|---|---|
| | 0.50 μm) | | Co., Ltd.) | |
| Ex. 6 | Granular titanium oxide (particle diameter 0.30 μm) | 40 | Silane coupling agent (KBM-602: produced by Shin-etsu Chemical Industry Co., Ltd.) | 0.3 |
| Ex. 7 | Granular hematite (particle diameter 0.60 μm) | 100 | Silane coupling agent (KBM-403: produced by Shin-etsu Chemical Industry Co., Ltd.) | 0.5 |
| Comp. Ex. 1 | Granular hematite (particle diameter 0.20 μm) | 160 | Silane coupling agent (KBM-403: produced by Shin-etsu Chemical Industry Co., Ltd.) | 1.2 |

| | | Phenol | Formalin | Basic catalyst | |
|---|---|---|---|---|---|
| | $r_b/r_a$ | Quantity (g) | Quantity (g) | Kind | Quantity (g) |
| Ex. 1 | 1.7 | 50 | 75 | Ammonia water | 15 |
| Ex. 2 | 1.7 | 45 | 67 | Ammonia water | 14 |
| Ex. 3 | 2.5 | 45 | 67 | Ammonia water | 14 |
| Ex. 4 | 1.1 | 47 | 71 | Ammonia water | 14 |
| Ex. 5 | 1.7 | 50 | 70 | Ammonia water | 12 |
| Ex. 6 | 1.3 | 45 | 67 | Ammonia water | 14 |
| Ex. 7 | 1.1 | 47 | 71 | Ammonia water | 14 |
| Comp. Ex. 1 | 0.83 | 40 | 60 | Ammonia water | 12 |

| | Suspension stabilizer | | Water | |
|---|---|---|---|---|
| | Kind | Quantity (g) | Quantity (g) | product |
| Ex. 1 | Calcium fluoride | 1.0 | 50 | A |
| Ex. 2 | — | — | 50 | B |
| Ex. 3 | — | — | 45 | C |
| Ex. 4 | — | — | 50 | D |
| Ex. 5 | — | — | 50 | E |
| Ex. 6 | — | — | 45 | F |
| Ex. 7 | — | — | 55 | G |
| Comp. Ex. 1 | — | — | 40 | H |

TABLE 2

| Product | Shape | Average particle diameter (μm) | Sphericity | Bulk density (g/ml) | Specific gravity |
|---|---|---|---|---|---|
| A | Spherical | 40.1 | 1.2 | 1.94 | 3.55 |
| B | Spherical | 38.5 | 1.2 | 1.92 | 3.58 |
| C | Spherical | 52.4 | 1.1 | 1.90 | 3.56 |
| D | Spherical | 45.4 | 1.2 | 1.81 | 3.55 |
| E | Spherical | 82.0 | 1.2 | 1.98 | 3.67 |
| F | Spherical | 44.2 | 1.1 | 1.88 | 3.47 |
| G | Spherical | 75.8 | 1.2 | 1.88 | 3.53 |
| H | Spherical | 42.1 | 1.1 | 1.99 | 3.65 |

| Product | Saturation magnetization (emu/g) | Electric resistance (Ωcm) | Content of inorganic particles (wt %) |
|---|---|---|---|
| A | 63 | $1 \times 10^{11}$ | 88.0 |
| B | 31 | $4 \times 10^{12}$ | 87.6 |
| C | 73 | $2 \times 10^{10}$ | 88.1 |
| D | 53 | $6 \times 10^{11}$ | 87.0 |
| E | 74 | $2 \times 10^{10}$ | 87.0 |

TABLE 2-continued

| | | | |
|---|---|---|---|
| F | 71 | $4 \times 10^{10}$ | 87.6 |
| G | 58 | $2 \times 10^{11}$ | 86.7 |
| H | 46 | $2 \times 10^{7}$ | 88.3 |

| Product | Content of ferromagnetic iron compound particles (wt %) | Content of non-magnetic metal oxide particles (wt %) | Content of non-magnetic metal oxide particles (ratio of non-magnetic metal oxide particles to the total amount of inorganic particles (wt %) |
|---|---|---|---|
| A | 70.5 | 17.5 | 19.9 |
| B | 35.1 | 52.5 | 60.0 |
| C | 81.6 | 6.5 | 7.4 |
| D | 61.2 | 25.8 | 29.7 |
| E | 82.2 | 4.8 | 5.5 |
| F | 78.8 | 8.8 | 10.0 |
| G | 65.2 | 21.5 | 24.8 |
| H | 52.1 | 36.2 | 41.0 |

TABLE 3

| | Coating layer of phenol resin or coating layer of phenol resin containing non-magnetic metal oxide particles | | | | |
|---|---|---|---|---|---|
| | Composite core particles | | Non-magnetic metal oxide particles | | Phenol |
| | Product | Quantity (g) | Kind | Quantity (g) | Quantity (g) |
| Ex. 8 | A | 100 | — | — | 2 |
| Ex. 9 | B | 100 | Granular hematite (particle diameter 0.16 μm) | 1 | 3 |
| Ex. 10 | C | 100 | — | — | 2 |
| Ex. 11 | D | 100 | Granular titanium oxide (particle diameter 0.10 μm) | 1 | 3 |
| Ex. 12 | E | 100 | — | — | 3 |
| Comp. Ex. 2 | H | 100 | — | — | 2 |

| | Coating layer of phenol resin or coating layer of phenol resin containing non-magnetic metal oxide particles | | | | |
|---|---|---|---|---|---|
| | Formalin (37%) Quantity | Basic catalyst | | Water Quantity | Composite |
| | (g) | Kind | Quantity (g) | (g) | particles |
| Ex. 8 | 2.7 | Ammonia water | 1 | 40 | I |
| Ex.9 | 4.1 | Ammonia water | 1.5 | 50 | J |
| Ex. 10 | 2.7 | Ammonia water | 1 | 40 | K |
| Ex. 11 | 4.1 | Ammonia water | 1.5 | 50 | L |
| Ex. 12 | 4.1 | Ammonia water | 1.5 | 40 | M |
| Comp. Ex. 2 | 2.7 | Ammonia water | 1 | 40 | N |

TABLE 4

| Product | Shape | Average particle diameter (μm) | Sphericity | Bulk density (g/ml) | Specific gravity |
|---|---|---|---|---|---|
| I | Spherical | 41.9 | 1.1 | 1.94 | 3.54 |
| J | Spherical | 41.1 | 1.2 | 1.92 | 3.55 |
| K | Spherical | 54.8 | 1.1 | 1.90 | 3.54 |
| L | Spherical | 49.0 | 1.1 | 1.85 | 3.56 |
| M | Spherical | 87.8 | 1.2 | 1.97 | 3.66 |
| N | Spherical | 44.1 | 1.2 | 1.98 | 3.64 |

| Product | Content of non-magnetic metal oxide particles (ratio of non-magnetic metal oxide particles to the total amount of inorganic particles) (wt %) | Content of phenol resin (wt %) | Saturation magnetization (emu/g) | Electric resistance (Ωcm) |
|---|---|---|---|---|
| I | 19.9 | 13.1 | 62 | $5 \times 10^{12}$ |
| J | 60.4 | 15.6 | 30 | $2 \times 10^{13}$ |
| K | 7.3 | 13.0 | 72 | $5 \times 10^{12}$ |
| L | 32.2 | 14.8 | 52 | $7 \times 10^{13}$ |
| M | 5.4 | 14.8 | 73 | $6 \times 10^{12}$ |
| N | 41.0 | 12.7 | 45 | $5 \times 10^{11}$ |

| Product | Charge of toner (toner (A)) (μC/g) | Charge of toner (toner (B)) (μC/g) | Quantity of phenol resin coating the particles (part by weight based on 100 parts by weight of core particles) | Content of non-magnetic metal oxide particles in coating layer (part by weight based on 100 parts by weight of core particles) |
|---|---|---|---|---|
| I | −58 | +7 | 1.2 | — |
| J | −60 | +8 | 1.8 | 1.0 |
| K | −53 | +8 | 1.2 | — |
| L | −70 | +5 | 1.8 | 1.0 |
| M | −50 | +9 | 1.8 | — |
| N | −52 | +10 | 1.1 | — |

Toner (A): Cannon CLC-200 Black
Toner (B): Ricoh-4800

TABLE 5

| | Coating layer of resin | | | | |
|---|---|---|---|---|---|
| | Composite core particles | | Resin | | |
| | Product | Quantity (g) | Kind | Quantity (g) | Composite particles |
| Ex. 13 | A | 1000 | Styrene resin Himer-SB-75 (produced by Sanyo Chemical Industries Co., Ltd.) | 20 | O |
| Ex. 14 | A | 1000 | Silicone resin KR-251 (produced by Shin-etsu Chemical Industry Co., Ltd.) | 30 | P |

TABLE 5-continued

| | Coating layer of resin | | | | |
|---|---|---|---|---|---|
| | Composite core particles | | Resin | | |
| | Product | Quantity (g) | Kind | Quantity (g) | Composite particles |
| Ex. 15 | B | 1000 | Polyester resin FC-023 (produced by Mitsubishi Rayon Company Limited) | 15 | Q |
| Ex. 16 | C | 1000 | Epoxy resin Epicron 850 (produced by Dai-Nippon Ink & Chemical Mfg. Co., Ltd.) | 15 | R |
| Ex. 17 | C | 1000 | Fluorine resin KF Polymer (produced by Kureha Kagaku Kogyo K.K.) | 10 | S |
| Ex. 18 | F | 1000 | Silicone resin KR-251 (produced by Shin-etsu Chemical Industry Co., Ltd.) | 15 | T |

TABLE 6

| Product | Shape | Average particle diameter (μm) | Sphericity | Bulk density (g/ml) | Specific gravity |
|---|---|---|---|---|---|
| O | Spherical | 40.8 | 1.2 | 1.86 | 3.53 |
| P | Spherical | 41.2 | 1.2 | 1.87 | 3.53 |
| Q | Spherical | 39.0 | 1.1 | 1.89 | 3.56 |
| R | Spherical | 53.1 | 1.1 | 1.89 | 3.54 |
| S | Spherical | 52.9 | 1.1 | 1.90 | 3.54 |
| T | Spherical | 44.8 | 1.1 | 1.87 | 3.46 |

| Product | Content of non-magnetic metal oxide particles (ratio of non-magnetic metal oxide particles to the total amount of inorganic particles) (wt %) | Content of phenol resin (wt %) | Saturation magnetization (emu/g) | Electric resistance (Ωcm) |
|---|---|---|---|---|
| O | 19.5 | 12.0 | 61 | $6 \times 10^{13}$ |
| P | 19.4 | 12.0 | 59 | $8 \times 10^{13}$ |
| Q | 59.3 | 12.4 | 31 | $7 \times 10^{13}$ |
| R | 7.3 | 11.9 | 72 | $4 \times 10^{13}$ |
| S | 7.3 | 11.9 | 72 | $8 \times 10^{12}$ |
| T | 10.0 | 12.4 | 70 | $5 \times 10^{13}$ |

| Product | Charge of toner (toner (A)) (μC/g) | Charge of toner (toner (B)) (μC/g) | Quantity of phenol resin coating the particles (part by weight based on 100 parts by weight of core particles) |
|---|---|---|---|
| O | −40 | +6 | 1.8 |
| P | −24 | +25 | 2.7 |

TABLE 6-continued

| | | | |
|---|---|---|---|
| Q | −32 | +12 | 1.2 |
| R | −26 | +15 | 1.2 |
| S | −5 | +40 | 0.8 |
| T | −43 | +20 | 1.2 |

Toner (A): Cannon CLC-200 Black
Toner (B): Ricoh-4800

What is claimed is:

1. A magnetic carrier for electrophotography having a number-average particle diameter of 1 to 1000 μm, and comprising ferromagnetic iron compound particles, non-magnetic metal oxide particles and a phenol-based resin as a binder resin, the total amount of said ferromagnetic iron compound particles and said non-magnetic metal oxide particles being 80 to 99 wt %, and the ratio of the number-average particle diameter of said non-magnetic metal oxide particles and the number-average particle diameter of said ferromagnetic iron compound particles being more than 1.0.

2. A magnetic carrier for electrophotography according to claim 1, wherein said number-average particle diameter of said ferromagnetic iron compound particles is 0.02 to 5 μm, and said number-average particle diameter of said non-magnetic metal oxide particles is 0.05 to 10 μm.

3. A magnetic carrier for electrophotography according to claim 1, wherein said content of said non-magnetic metal oxide particles is 5 to 70 wt % in the total amount of said ferromagnetic iron compound particles and said non-magnetic metal oxide particles.

4. A magnetic carrier for electrophotography according to claim 1, wherein the saturation magnetization of said spherical composite particles is 20 to 90 emu/g, the true specific gravity thereof is 2.5 to 5.2, and the electric resistance thereof is $10^{10}$ to $10^{14}$ Ωcm.

5. A magnetic carrier for electrophotography according to claim 1, wherein the sphericity of said spherical composite particles is 1.0 to 1.4.

6. A magnetic carrier for electrophotography according to claim 1, wherein the bulk density of said spherical composite particles is not more than 2.5 g/cm$^3$.

7. A magnetic carrier for electrophotography according to claim 1, wherein said ferromagnetic iron compound particles are one selected from the group consisting of ferromagnetic iron oxide particles, spinel ferrite particles containing at least one metal other than iron, magnetoplumbite ferrite particles and fine iron or iron alloy particles having an oxide film on the surfaces thereof.

8. A magnetic carrier for electrophotography according to claim 1, wherein said non-magnetic metal oxide particles are one selected from the group consisting of titanium oxide particles, silica particles, alumina particles, zinc oxide particles, magnesium oxide particles, hematite particles, goethite particles and ilmenite particles.

9. A magnetic carrier for electrophotography according to claim 1, wherein said ferromagnetic iron compound particles and said non-magnetic metal oxide particles are subjected to a lipophilic surface treatment.

10. A magnetic carrier for electrophotography according to claim 1, wherein said spherical composite particles have a coating layer composed of at least one selected from the group consisting of a thermoplastic resin and a thermosetting resin on the surfaces thereof.

11. A magnetic carrier for electrophotography according to claim 10, wherein said coating layer contains fine non-magnetic metal oxide particles.

12. A magnetic carrier for electrophotography according to claim 10, wherein the amount of said coating layer is 0.1 to 50 parts by weight based on 100 parts by weight of said spherical composite core particles.

13. A magnetic carrier for electrophotography according to claim 11, wherein the amount of said coating layer is 0.2 to 50 parts by weight based on 100 parts by weight of said spherical composite core particles, the amount of said non-magnetic metal oxide particles contained in said coating layer is 0.1 to 10 parts by weight based on 100 parts by weight of said spherical composite core particles, and the amount of said resin in said coating layer is 0.1 to 50.0 parts by weight based on 100 parts by weight of said spherical composite core particles.

14. A magnetic carrier for electrophotography according to claim 11, wherein said fine non-magnetic metal oxide particles contained in said coating layer are one selected from the group consisting of titanium oxide particles, silica particles, alumina particles, zinc oxide particles, magnesium oxide particles, hematite particles, goethite particles and ilmenite particles.

15. A magnetic carrier for electrophotography according to claim 11, wherein the average particle diameter of said fine non-magnetic metal oxide particles contained in said coating layer is not more than 1 μm.

16. A developer for electrophotography comprising a carrier define in claim 1, and a toner.

* * * * *